US007018267B2

(12) United States Patent
Delaney et al.

(10) Patent No.: US 7,018,267 B2
(45) Date of Patent: Mar. 28, 2006

(54) TRANSPORTABLE PLAY ASSEMBLY

(75) Inventors: Thomas J. Delaney, Manhattan Beach, CA (US); Jennifer L. Delaney, Manhattan Beach, CA (US)

(73) Assignee: Homegrown Kids, Inc., Manhattan Beach, CA (US)

( * ) Notice: Subject to any disclaimer, the term of this patent is extended or adjusted under 35 U.S.C. 154(b) by 199 days.

(21) Appl. No.: 10/753,764

(22) Filed: Jan. 8, 2004

(65) Prior Publication Data

US 2005/0153630 A1 Jul. 14, 2005

(51) Int. Cl.
*A63H 33/00* (2006.01)

(52) U.S. Cl. ..... 446/487; 446/478; 446/71; 446/488; 135/125; 135/143; 5/420; 5/417; 383/4

(58) Field of Classification Search ..... 446/487, 446/75, 46, 478, 227; 150/118, 120; 273/285, 273/286; 5/655, 417, 420; 383/4; 135/125, 135/126, 128, 143
See application file for complete search history.

(56) References Cited

U.S. PATENT DOCUMENTS

| | | | | |
|---|---|---|---|---|
| 2,667,353 | A | 1/1954 | Lanice | |
| 4,815,784 | A | 3/1989 | Zheng | |
| D308,127 | S * | 5/1990 | Doyel | D3/20 |
| 5,035,013 | A * | 7/1991 | Bloom | 5/420 |
| 5,059,463 | A * | 10/1991 | Peters | 428/64.1 |
| 5,301,705 | A * | 4/1994 | Zheng | 135/126 |
| 5,335,684 | A * | 8/1994 | Hanninen | 135/128 |
| 5,398,848 | A * | 3/1995 | Padamsee | 222/94 |
| 5,467,794 | A | 11/1995 | Zheng | |
| 5,480,229 | A * | 1/1996 | Thangsrirojkul | 383/4 |
| 5,542,560 | A * | 8/1996 | Gerster et al. | 220/252 |
| 5,560,385 | A | 10/1996 | Zheng | |
| 5,664,596 | A | 9/1997 | Zheng | |
| 5,816,279 | A | 10/1998 | Zheng | |
| 5,941,265 | A | 8/1999 | Zheng | |
| 5,971,611 | A * | 10/1999 | Rosengren | 383/4 |
| 5,975,101 | A | 11/1999 | Zheng | |
| 6,006,772 | A | 12/1999 | Zheng | |
| 6,032,685 | A | 3/2000 | Zheng | |
| 6,138,701 | A | 10/2000 | Zheng | |
| 6,199,229 | B1 * | 3/2001 | Wong | 5/417 |
| 6,267,129 | B1 | 7/2001 | Zheng | |
| 6,269,826 | B1 | 8/2001 | Zheng | |
| 6,305,396 | B1 | 10/2001 | Zheng | |
| 6,648,799 | B1 * | 11/2003 | Hall | 482/28 |
| 6,905,015 | B1 * | 6/2005 | Hernandez et al. | 206/45.24 |

FOREIGN PATENT DOCUMENTS

GB 2094367 A * 9/1982

OTHER PUBLICATIONS

Google Image Search—"circular folding", Internet—http://www.google.com, 2005.*

* cited by examiner

*Primary Examiner*—Derris H. Banks
*Assistant Examiner*—Urszula M. Cegielnik
(74) *Attorney, Agent, or Firm*—Squire, Sanders & Dempsey, LLP; Douglas N. Larson

(57) ABSTRACT

A transportable play design assembly with an open operative position, an alternative closed position and which may be folded to enclose play items therebetween when play time is concluded. The open operative position is utilized as a play surface. The alternative closed position is utilized as a transporting and storage device for play items. The alternative closed position further has a closing mechanism to prevent the play items from falling out of the assembly during transportation.

31 Claims, 4 Drawing Sheets

TRANSPORTABLE PLAY ASSEMBLY

BACKGROUND OF THE INVENTION

Transportable play mats which act as a barrier between the surface of the ground and the child are known. Such devices can provide a clean play area for a child either inside or outside the home. They may also provide a convenient way to gather and transport toys or other play items once play time is concluded.

Generally, such devices are made of some type of cloth material. One problem associated with the design of such devices is that they typically must be manually spread out by an adult or adolescent of appropriate age in order to maximize the surface area of the play mat. Additionally, the risk of the child tripping or falling in the play area is increased due to folded corners or wrinkles forming when manually spread out. Furthermore, dirt may easily accumulate on the surface of such a play mat if used in an outdoor environment, defeating the purpose of providing a clean play area for the child.

Other games or play mats known in the art teach that they may be folded and transported once play time is concluded. See, e.g., U.S. Pat. No. 6,554,685 B2 (Lish), U.S. Pat. No. 3,948,528 (Goodman, Jr.), and U.S. Pat. No. 2,667,353 (Lanice). These patents, however, exhibit the same problems as outlined above due to the fact that they must be manually spread out.

In addition to the problems associated with the play mats which must be manually spread out, a separate problem presented by such devices is the inadequacy of their closing mechanisms for quick and efficient storage and transportability. See, e.g., U.S. Pat. No. 5,429,541 (Landon); U.S. Pat. No. 5,971,611 (Rosengren). The closing mechanisms of those devices frequently comprise a drawstring cord. The drawstring cord is attached or strung through the periphery of the device leaving some portion of the cord exposed. The exposed portion of the cord, however, presents a danger of the child getting his or her foot caught on it and tripping. Additionally, the devices with the closing mechanism described result in a pouch-like container when in the closed position. Such pouch-like configurations may be undesirable for transportation purposes since they are bulky and cumbersome. Furthermore, such closed configurations cannot conveniently be stored out of sight.

SUMMARY OF THE INVENTION

One aspect of the present invention is to provide a play design mat which automatically takes the shape of its peripheral edges and does not have to be manually spread out to achieve the open position. This is accomplished by providing reinforcing flexible frame members substantially around the entire periphery of the panel. Such design eliminates the need for an adult or adolescents of appropriate age to manually spread out the panel and allows the child to do so independently. Additionally, the risk of the child tripping or falling on folded corners or wrinkles formed when the panel is spread out is virtually eliminated because the reinforcing flexible frame members cause the play area to be taut with respect to the frame members. Finally, the design of the present invention is less likely to accumulate dirt and more likely to provide a clean play area as compared to those designs in the prior art because the taut nature of the play area does not present such an opportunity.

Another aspect of the invention is to provide a play design mat which can act as a storage container that can be easily transported after play time is concluded. This is accomplished by providing two panels which make up the play area and which are positioned such that they can be folded along their line of separation to form a folded closed configuration. Beneficially, the play items, e.g., toy cars, figures, or game pieces, are left on the play mat when folded and do not have to be separately carried or risk getting lost once the play mat is closed and prepared for transportation. Advantageously, a closing mechanism, such as a zipper, seals the two separate panels together when in the folded closed configuration such that the play items cannot fall out. Ease of transportability is accomplished by a recessed handle hold openings on each of the separate panels which may be gripped for easy carrying. Finally, the relatively flat folded closed configuration allows for out of sight storage in narrow areas, such as behind or under furniture.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 5(*b*) is an enlarged cross-sectional view taken on line 5(*b*)—5(*b*) of FIG. 3.

FIG. 6(*b*) illustrates a second step for further folding of the closed configuration of FIG. 3 for packaging purposes.

FIG. 6(*c*) illustrates a third step for further folding of the closed configuration of FIG. 3 for packaging purposes.

DETAILED DESCRIPTION OF PREFERRED EMBODIMENTS OF THE INVENTION

Figure 1:
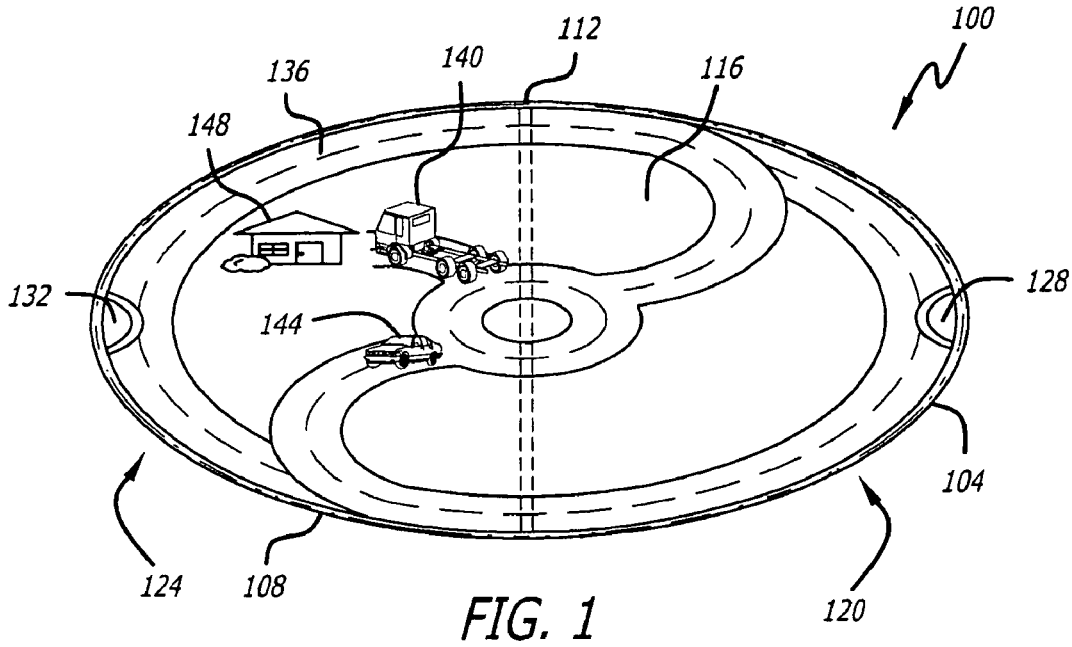
FIG. 1 is a perspective view of a play mat of the present invention with indicia and play items and illustrated in the open configuration.

In FIG. 1, the transportable play design mat 100 is illustrated in the open configuration. A first non-continuous flexible frame member 104 defines the periphery of a first play panel 120. A second non-continuous flexible frame member 108 defines the periphery of a second play panel 124. Each flexible frame member 104 and 108 may be made of fiberglass, but other materials such as plastic coated metal may be suitable. Additionally, each of the play panels 120 and 124 can be approximately thirty-two to forty inches at its widest location. Although shown in a substantially circular configuration in FIG. 1, other geometric configurations are contemplated by the present invention.

Continuing to refer to FIG. 1, the first play panel 120 is diametrically disposed to the second play panel 124 at the hinge 112 such that they define the play area of the play design mat 100. The hinge 112 may be a reinforced sewn stitching or an elongated fabric bead spanning the length of the hinge 112; however, the hinge 112 can alternatively be completely non-reinforced. A flexible sheet 116 substantially spans the area defined by the flexible frame members 104 and 108 and defines the surface area of the play design mat 100. The flexible sheet 116 may comprise a vinyl or plastic material; however, it should be appreciated that other materials may be used. Furthermore, the flexible sheet 116 is held taut by its peripheral edges wrapped around the flexible frame members 104 and 108 and subsequently attached to itself by a reinforcing stitch. The taut construction of the play design panel 100 allows for the panel to take on a predefined shape when in the open position and eliminates the need for spreading it out manually.

FIG. 1 further illustrates a first opening 128 positioned at a location furthest from the center of the hinge 112 on the first play panel 120 defining a handle hold when in the closed transportable storage position (not shown in this figure). A second opening 132 is similarly positioned on the second play panel 124 in an equal opposite location to that of the first opening 128 and similarly defines a handle hold when in the closed transportable storage position (not shown in this figure). The openings 128 and 132 allow for ease of carrying of the play design panel 100 when in the closed transportable storage position.

Finally, FIG. 1 shows indicia 136 forming at least one play path along which a user can move a play piece 140 or 144 on the play design mat 100, or alternatively forming indicia 136 which may include representations of housing 148 or a city, town, ocean, construction or similar theme on the flexible sheet 116. It should be appreciated that the indicia 136 on the play design mat 100 may comprise a game theme or alternatively comprise a gender-specific theme, such as a construction theme for boys or a shopping theme for girls. It should also be appreciated that each play panel 120 and 124 may include individually different play themes independent of one another. Last, for indicia 136 representing a game theme, the play pieces 140 or 144 will comprise game pieces, such as chess or checker pieces.

Figure 2:
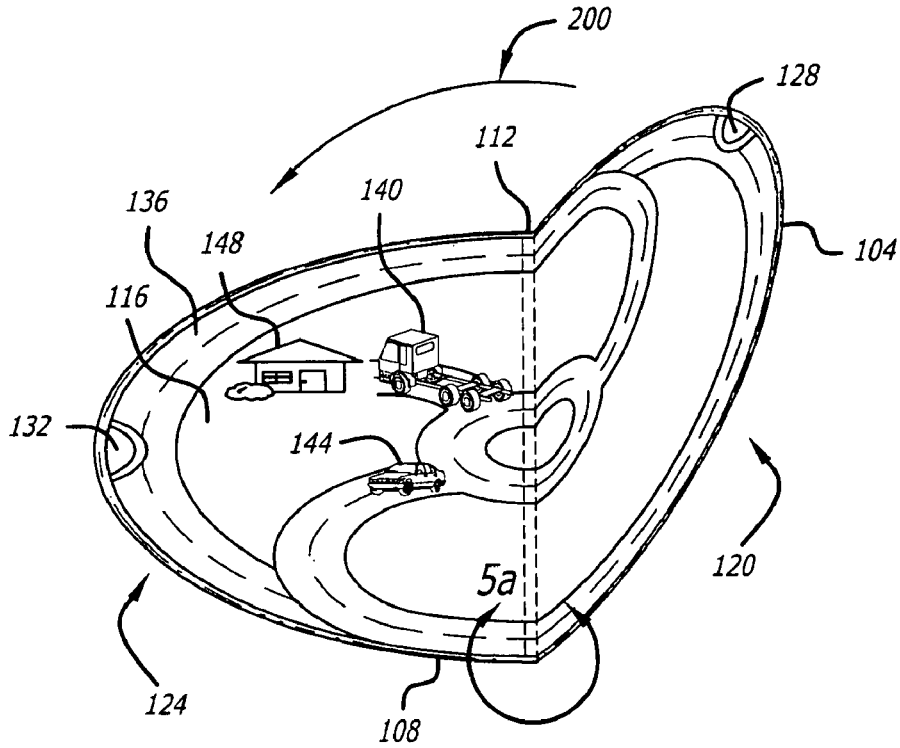
FIG. 2 is a perspective view of a first play panel of the play mat of FIG. 1 being folded over a second play panel of the play mat to accomplish a closed configuration.

Referring now to FIG. 2, the play design mat 100 is illustrated as it begins to be positioned to the closed transportable storage position (not shown in this figure). The first play panel 120 is folded along the hinge 112 and begins to overlie the second play panel 124. The play pieces 140 or 144 remain positioned on the flexible sheet 116 during the folding movement as shown by arrow 200. Advantageously, the play pieces 140 or 144 are therefore able to be transported securely within the play design mat 100 without having to be carried separately and risk getting lost.

Figure 3:
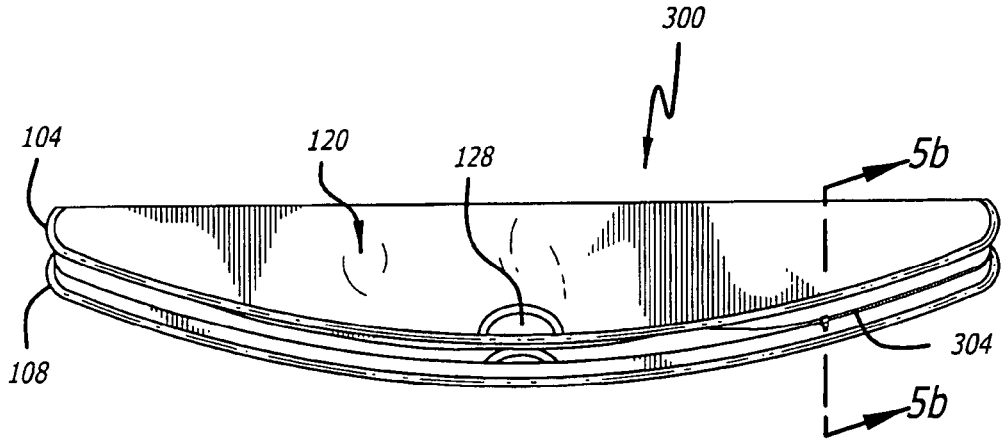
FIG. 3 is a perspective view of the play mat of FIG. 1 in a closed configuration with the closing mechanism thereof partially engaged.

In FIG. 3, the closed transportable storage position 300 of the play design mat 100 is illustrated. The first play panel 120 completely overlies the second play panel 124 which may be folded along the hinge 112 to form the closed transportable storage position 300. A closing mechanism 304 spans the periphery of the closed storage position 300, except along the hinge 112. The closing mechanism 304 may be a zipper, Velcro®, snaps or similar closing mechanism. The closing mechanism beneficially prevents the play pieces 140 or 144 enclosed in the closed transportable storage position 300 from falling out. Furthermore, the enclosed play pieces 140 or 144 may be easily transported in the closed storage position 300.

Figure 4:
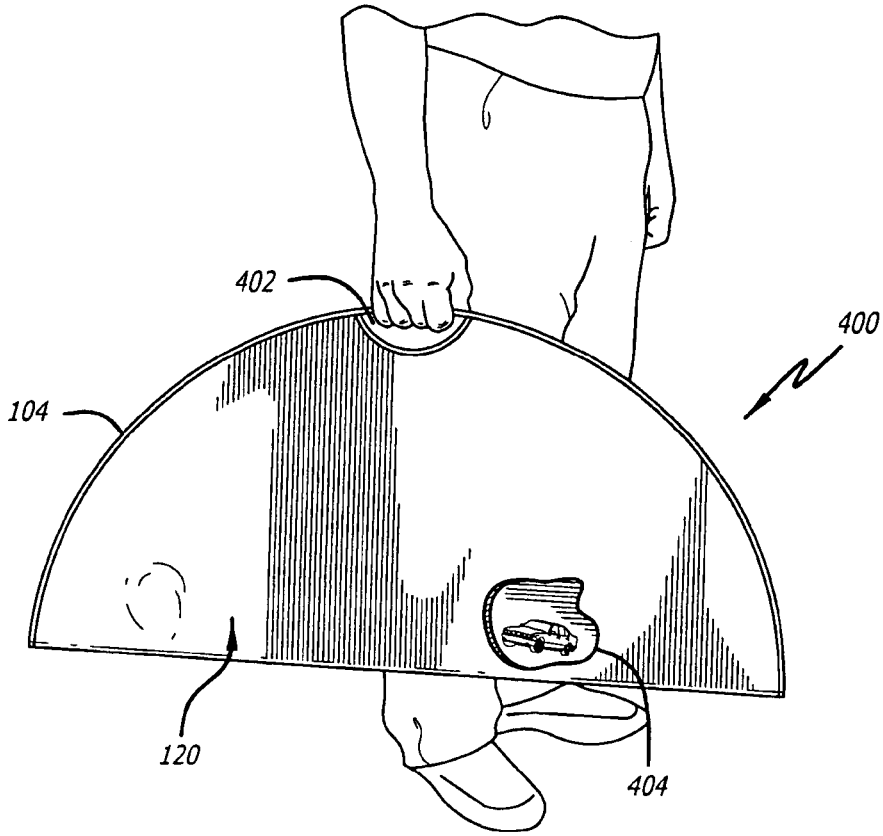
FIG. 4 is a perspective view showing a user gripping the handle hold openings of the closed play mat of FIG. 3 with the play items remaining therebetween in preparation for transportation.

Referring now to FIG. 4, the play design mat 100 in a transportable position 400 is illustrated. The openings 128 and 132 may be overlaid on top of one another forming a handle hold 402. By gripping the handle hold 402, a user may easily and conveniently transport the play design panel 100 when in the closed transportable storage position 300. Cut-out area 404 in the flexible sheet 116 illustrates a play piece 140 being transported in the transportable position 400.

Figure 5A:
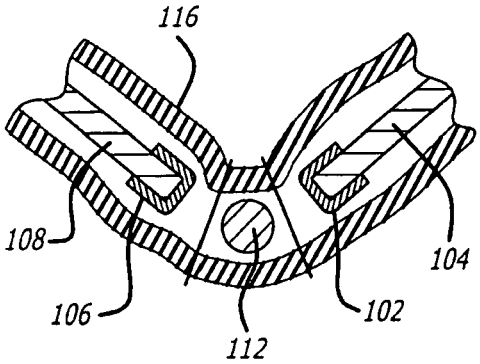
FIG. 5(*a*) is an enlarged view taken on circle 5(*a*) of FIG. 2.
Figure 5B:
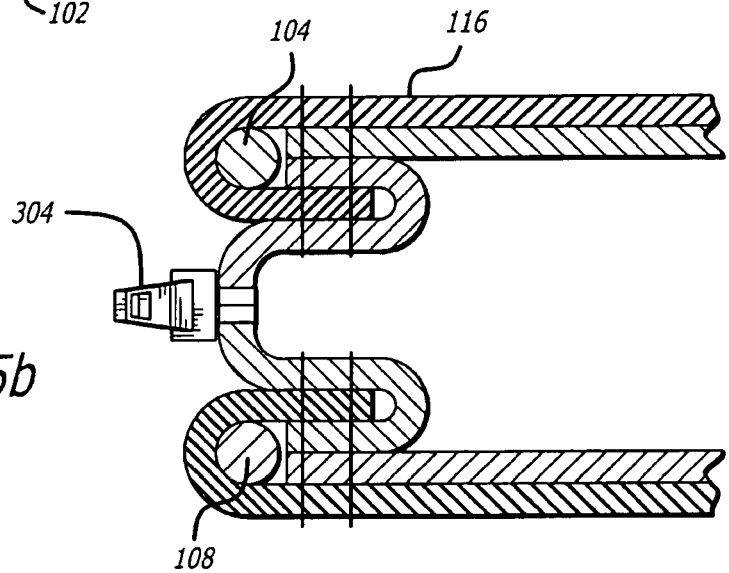

In FIG. 5(*a*), a cross-sectional view of the hinge area as referenced in FIG. 2 is illustrated. The first non-continuous flexible frame member 104 remains approximately 0.5 to 1.5 inches from the hinge 112 and has a cap 102 on its end for protective purposes. Similarly, the second non-continuous flexible frame member 108 remains approximately 0.5 to 1.5 inches from the hinge 112, and has a cap 106 on its end, respectively. As a result, a one to three inch gap is realized between the diametrically disposed flexible frame members 104 and 108 at the location near the hinge 112 where they would otherwise meet.

In FIG. 5(*b*), a cross-sectional view of an end corner in the closed transportable storage position 300 as referenced in FIG. 3 is illustrated. As shown in this illustration, the width between the flexible frame member 104 and the flexible frame member 108 is approximately one to three inches, allowing the present invention to easily be stored out of sight behind furniture as an example.

Figure 6A:
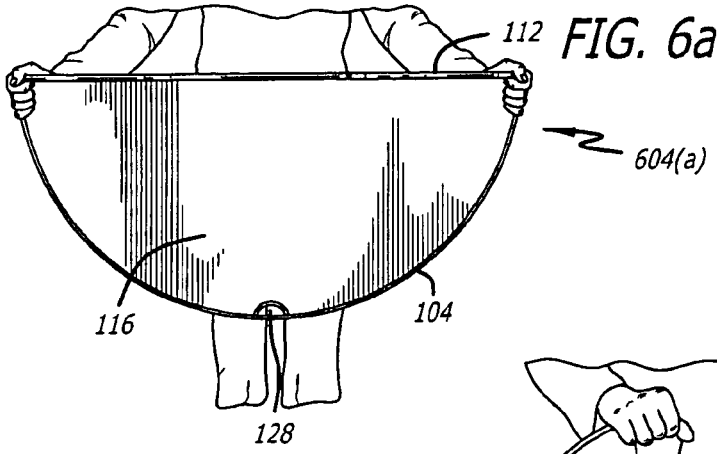
FIG. 6(*a*) illustrates a first step for further folding of the closed configuration of FIG. 3 for packaging purposes.
Figure 6B:
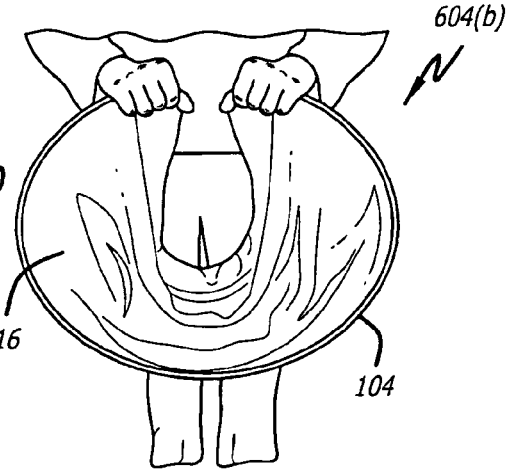
Figure 6C:
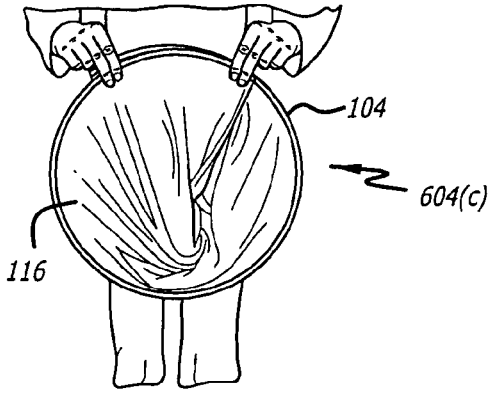

FIGS. 6(*a*) through 6(*c*) illustrate a way in which the play design mat 100 may be further folded for packaging purposes, such as by the manufacturer. FIG. 6(*a*) demonstrates the gripping of the end portions of the play design mat 100 when in the closed transportable storage position 300. FIG. 6(*b*) demonstrates the two end portions of the play design mat 100 folding toward each to achieve the configuration illustrated in FIG. 6(*c*). Finally, FIG. 6(*c*) shows the play design mat 100 in a further folded configuration 604(*c*) which may be desirable, from a manufacturer's perspective, for packaging purposes and, from a retailer's perspective, for taking up less shelf space. It should be noted that a twisting action is not required at any step in order to ultimately achieve the further folded configuration 604(*c*).

Figure 7:
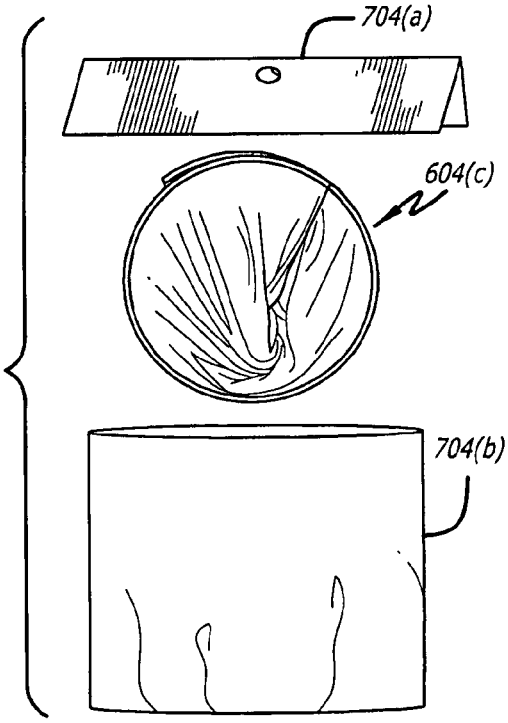
FIG. 7 is an exploded view of the further folded configuration of FIG. 6(*c*) accompanied by its packaging.

In FIG. 7, the further folded configuration 604(*c*) with its accompanying packaging 704(*a*) and 704(*b*) is illustrated. Because the play design mat 100 may be reduced in size to the further folded configuration 604(*c*), costs in manufacturing packaging expenses may be substantially reduced and less display and/or storage space is needed by the retailer.

Figure 8:
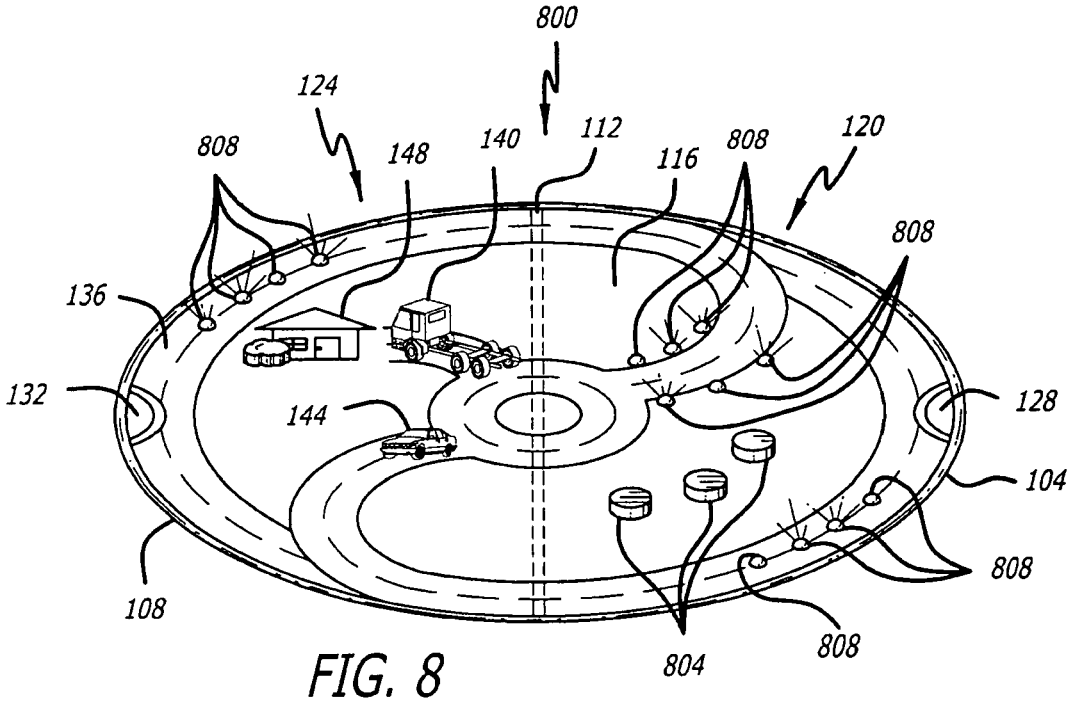
FIG. 8 is a perspective view of an alternative play mat of the present invention similar to that of FIG. 1 with push buttons, sound and light emitting devices, indicia and play items in the open configuration of FIG. 1.

In FIG. 8, an alternative preferred embodiment of the play design mat 100 with push buttons 804 and sound and/or light emitting elements 808 is illustrated. Play items 140 or 144 are additionally illustrated in this alternative preferred embodiment.

From the foregoing detailed description, it will be evident that there are a number of changes, adaptations and modifications of the present invention which come within the province of those skilled in the art. The scope of the invention includes any combination of the elements from the different species or embodiments disclosed herein, as well as subassemblies, assemblies, and methods thereof. However, it is intended that all such variations not departing from the spirit of the invention be considered as within the scope thereof.

What is claimed is:

1. A foldable play assembly, comprising:

at least two non-continuous reinforcing flexible frame members, each shaped in a substantially semi-circular configuration and diametrically disposed to each other such that the frame members form a substantially circular configuration;

a flexible sheet substantially covering the area of the substantially circular configuration and folded over each reinforcing frame member such that the reinforcing members are not exposed; and a hinge disposed at the median of the substantially circular configuration spanning the width of the substantially circular configuration and dividing the substantially circular configuration into two substantially semi-circular panels.

2. The assembly of claim 1, wherein the non-continuous reinforcing flexible frame members are in the same plane as the flexible sheet.

3. The assembly of claim 1, wherein the two substantially semi-circular panels are approximately thirty-six inches at the diameter.

4. The assembly of claim 1, wherein the flexible sheet is made of vinyl.

5. The assembly of claim 1, wherein the closed position is realized when one substantially semi-circular panel is overlaid on top of the other such that they form one substantially semi-circular configuration.

6. The assembly of claim 5, further comprising a closing mechanism spanning the entire circumferential portion of the one substantially semi-circular panel.

7. The assembly of claim 5, wherein the closing mechanism is a zipper.

8. The assembly of claim 5, wherein the opposite corners of the substantially semi-circular configuration are adapted to roll inward toward each other along the diameter to form a rounded configuration.

9. The assembly of claim 1, wherein the open position is realized when the substantially two semi-circular panels are diametrically disposed to each other such that they form a substantially circular configuration forming a play surface.

10. The assembly of claim 9, wherein indicia form at least one of a city, town, ocean and construction on the play surface.

11. The assembly of claim 9, further comprising at least one button which activates a light on at least one location on the play surface when pressed.

12. The assembly of claim 9, further comprising at least one button which activates a sound on at least one location on the play surface when pressed.

13. The assembly of claim 9, further comprising at least one play piece positionable at a desired location on the play surface by a user.

14. The assembly of claim 9, wherein indicia forms at least one play path on the play surface along which a user can move the at least one play piece.

15. The assembly of claim 1, wherein each of the two substantially semi-circular panels include an opening at the location most distant from the center of the hinge and inside of the periphery of each substantially semi-circular panel defining a handle.

16. The assembly of claim 1, wherein the hinge comprises a reinforced sewn stitch or an elongated fabric bead.

17. A foldable play assembly, comprising:

at least two non-continuous reinforcing flexible frame members, each shaped in a substantially semi-circular configuration and diametrically disposed to one another such that the frame members form a substantially circular configuration and such that when overlaid on top of each other, they form a substantially semi-circular configuration with diametrically opposed corners which are adapted to be used to collapse the flexible frame members to a smaller size by rolling the corners inward toward each other to form a substantially rounded configuration;

a flexible sheet substantially covering the area of the substantially circular configuration and folded over each reinforcing frame member such that the reinforcing members are not exposed; and a hinge disposed at the median of the substantially circular configuration spanning the width of the substantially circular configuration and dividing the substantially circular configuration into two substantially semi-circular panels.

18. The assembly of claim 17, wherein the non-continuous reinforcing flexible frame members are in the same plane as the flexible sheet.

19. The assembly of claim 17, wherein the two substantially semi-circular panels are approximately thirty-six inches at the diameter.

20. The assembly of claim 17, wherein the flexible sheet is made of vinyl.

21. The assembly of claim 17, wherein the closed position is realized when one substantially semi-circular panel is overlaid on top of the other to such that they form one substantially semi-circular configuration.

22. The assembly of claim 21, wherein a closing mechanism spans the entire circumferential portion of the one substantially semi-circular panel.

23. The assembly of claim 22, wherein the closing mechanism is a zipper.

24. The assembly of claim 17, wherein the open position is realized when the two substantially semi-circular panels are diametrically disposed to each other such that they form a substantially circular configuration forming a play surface.

25. The assembly of claim 24, wherein indicia form at least one of a city, town, ocean and construction on the play surface.

26. The assembly of claim 24, further comprising at least one button which activates a light on at least one location on the play surface when pressed by a user.

27. The assembly of claim 24, further comprising at least one button which activates a sound on at least one location on the play surface when pressed by a user.

28. The assembly of claim 24, further comprising at least one play piece positionable at a desired location on the play surface by a user.

29. The assembly of claim 24, wherein indicia forms at least one play path on the play surface along which a user can move the at least one play piece.

30. The assembly of claim 17, wherein each of the two substantially semi-circular panels includes an opening at the location most distant from the center of the hinge and inside of the periphery of each substantially semi-circular panel defining a handle.

31. The assembly of claim 17, wherein the hinge comprises a reinforced sewn stitch or an elongated fabric bead.

* * * * *